US005148941A

United States Patent [19]

Chezek

[11] Patent Number: 5,148,941

[45] Date of Patent: Sep. 22, 1992

[54] POWDER DRUM

[76] Inventor: Norman A. Chezek, 100 Hepburn Rd. 4G, Clifton, N.J. 07012

[21] Appl. No.: 726,357

[22] Filed: Jul. 5, 1991

[51] Int. Cl.[5] ..... B65D 43/16

[52] U.S. Cl. ..... 220/408; 206/235; 206/581; 206/823; 132/293

[58] Field of Search ..... 220/352, DIG. 6, 870, 220/408; 206/823, 581, 235; 132/293, 286, 294

[56] References Cited

U.S. PATENT DOCUMENTS

| | | | |
|---|---|---|---|
| 1,875,127 | 9/1932 | Parkin | 220/326 |
| 2,143,058 | 1/1939 | Decker . | |
| 2,217,307 | 10/1940 | Carter et al. . | |
| 2,307,648 | 1/1943 | Tremolieres . | |
| 2,365,908 | 12/1944 | Runnels . | |
| 2,446,080 | 7/1948 | Dennis . | |
| 2,449,196 | 9/1948 | Bent . | |
| 2,466,875 | 4/1949 | Brandt . | |
| 2,497,692 | 2/1950 | Schulfer . | |
| 2,527,169 | 10/1950 | Wiggins . | |
| 2,560,675 | 7/1951 | Wheller et al. . | |
| 2,656,090 | 10/1953 | Hamblet . | |
| 3,398,847 | 6/1968 | Darot | 206/823 |
| 3,871,390 | 3/1975 | Spatz . | |
| 4,162,010 | 7/1979 | Hovsepian . | |
| 4,331,168 | 5/1982 | Hatakgyama | 220/581 |
| 4,446,879 | 5/1984 | Gueret . | |
| 4,674,520 | 6/1987 | Gretshel et al. . | |
| 4,777,969 | 10/1988 | Holloway . | |
| 4,964,526 | 10/1990 | Stephens | 206/823 |
| 4,979,525 | 12/1990 | Chiou | 206/581 |
| 5,078,159 | 1/1992 | Yuhara | 206/581 |
| 5,092,354 | 3/1992 | Pacelli, Jr. | 206/823 |

*Primary Examiner*—Joseph Man-Fu Moy

*Attorney, Agent, or Firm*—Hill, Van Santen, Steadman & Simpson

[57] ABSTRACT

An improved powder drum for containing a dry powder having a drum portion and a cover portion. The drum portion having a side wall with a predetermined configuration, an open top end and a bottom end with an aperture therein, having a predetermined configuration. A closure is provided on the open top end of the drum portion that completely closes the top end. The cover portion has a side wall with substantially the same configuration as the predetermined configuration of the side wall of the drum portion and telescopes over the side wall of the drum portion. The cover portion also has a bottom end having a concavity that mates with and extends substantially through the aperture in the bottom end of the drum portion. The concavity has substantially the same configuration as the aperture. A flocked material substantially covers an inner surface of the side wall, the bottom end and the concavity of the cover portion and seals the assembled drum portion and cover portion. During assembly, the flock material substantially prevents the dry powder from escaping from the drum portion.

20 Claims, 1 Drawing Sheet

POWDER DRUM

BACKGROUND OF THE INVENTION

The present invention relates in general to containers and more particularly to a drum type container for the containment of dry powder, such as talcum powder.

Containers for powder materials, such as talcum powder used in the cosmetic industry, are well known in the prior art. During manufacture of such powder drums it is known to fill the powder drum from an aperture in the bottom end of the drum, the bottom end of the drum then being sealed with a plug. Such a powder drum is disclosed in U.S. Pat. No. 4,674,520. It has been found in the prior art that during filling of the powder drum in the manufacturing process, a certain amount of powder escapes into the air when the plug is inserted into the aperture in the bottom of the powder drum. The escaping powder is an undesirable result of the manufacturing process.

The present invention overcomes this drawback of the prior art.

SUMMARY OF THE INVENTION

It is a general object of the present invention to provide an improved powder drum which is economical to manufacture and which prevents loss of the dry powder during manufacture of the powder drum.

It is a further object of the present invention to provide an inexpensive powder drum which can be sealed after the powder drum is filled by a means of allowing air to escape from the powder drum without substantially allowing the dry powder to escape from the powder drum.

The present invention is an improved powder drum having a means for containing a dry powder which has at least one side wall with top and bottom ends. The top end is substantially open and the bottom end has a predetermined aperture. A means for closing the top end is provided as well as a means for covering the bottom end and at least a portion of the side wall of the means for containing. The means for covering has at least one side wall that mates with the side wall of the means for containing and has a closed bottom end. The closed bottom end of the means for covering has a concave portion that substantially mates with the aperture in the bottom end of the means for containing. A means for sealing the dry powder in the means for containing, at least during assembly of the means for containing and the means for covering, substantially covers an inner surface of the means for covering.

In a preferred embodiment of the present invention, the improved powder drum has a drum portion for containing the dry powder with a side wall having a predetermined configuration. The drum portion has an open top end and a bottom end with the aperture therein having a predetermined configuration. The open top end of the drum portion has a closure that completely closes the top end. A cover portion is provided and has a side wall with substantially the same configuration as the predetermined configuration of the side wall of the drum portion. The cover portion telescopes over the drum portion and has a concavity in a closed bottom end thereof that mates with and extends substantially through the aperture in the bottom end of the drum portion. The concavity has substantially the same configuration as the predetermined configuration of the aperture. A flocked material substantially covers an inner surface of the side wall, the bottom end and the concavity of the cover portion for sealing the drum portion and the cover portion. The flocked material substantially prevents the dry powder from escaping from the drum portion at least when the drum portion is assembled with the cover portion.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
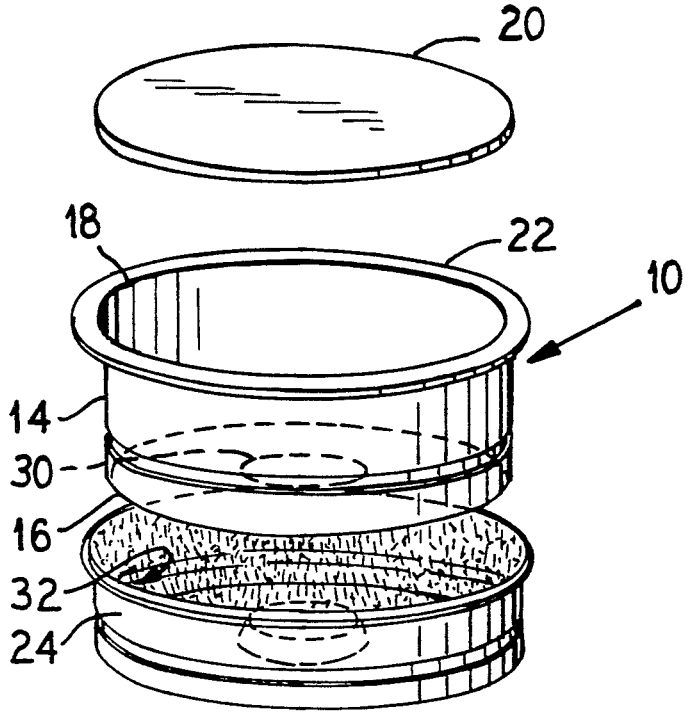
FIG. 1 is an exploded perspective view of the powder drum of the present invention.

The present invention has general applicability, but is most advantageously utilized in a powder drum as depicted in FIG. 1.

Figure 2:
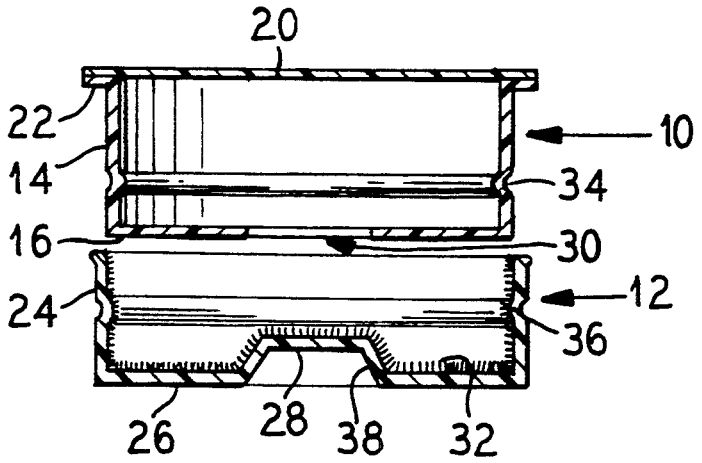
FIG. 2 is a cross-sectional view of a drum portion and a cover portion before assembling.
Figure 3:
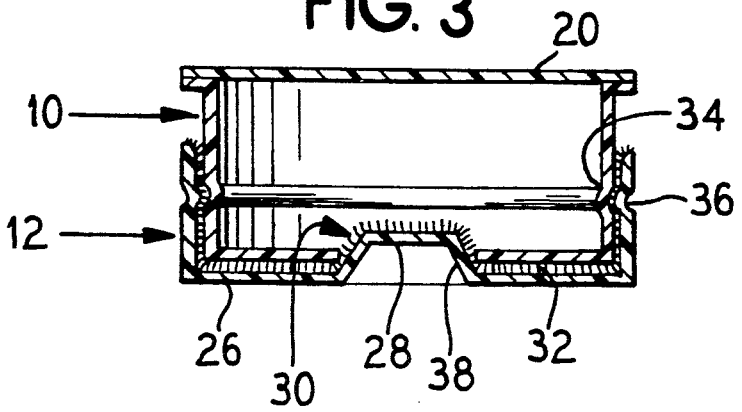
FIG. 3 is a cross-sectional view of the assembled drum portion and cover portion of the powder drum of the present invention.

The powder drum of the present invention is depicted in an exploded perspective view in FIG. 1, in an unassembled cross-sectional view in FIG. 2 and in an assembled crosssectional view in FIG. 3. The improved powder drum has a drum portion 10 and a cover portion 12. In the preferred embodiment the drum portion 10 and the cover portion 12 are formed of plastic by vacuum forming or other processes well known in the prior art. It is to be understood, however, that other materials could be utilized to manufacture the components of the present invention.

The drum portion 10 has a side wall 14 which has a predetermined configuration, an open top end 16 and a bottom end 18. In the disclosed embodiment as depicted in FIG. 1, the powder drum of the present invention has a circular configuration and thus has a single side wall 14. However, it is envisioned and encompassed by the present invention that the drum portion 10 can have other configurations, such as, square, oval or rectangular. Thus in embodiments such as square, the drum portion would have a plurality of side walls. The present invention can be utilized with a powder drum having any configuration of the side walls of the drum portion.

A closure 20 is attached to the open top end 18 of the drum portion 10 and completely closes the open top end 18. The closure 20 can be a paper material or other frangible type materials which is heat-sealed or glued to a top flange 22 on the open top end 18 of the drum portion 10. The closure 20 provides a leak-proof seal at the top end 18. Other types of materials including non-frangible structures could be utilized to provide a closure for the open top end 18 of the drum portion 10 depending upon the designed and application of the powder drum.

The cover portion 12 also has a side wall 24 with substantially the same configuration as the predetermined configuration of the side wall 14 of the drum portion 10. The side wall 24 of the cover portion 12 telescopes over the side wall 14 of the drum portion 10 during manufacture of the powder drum and after the drum portion 10 has been filled with dry powder. The cover portion 12 has a bottom end 26 with a concavity 28 that mates with and extends substantially through an aperture 30 in the bottom end 16 of the drum portion 10. During manufacture after the closure 20 is attached to the flange 22 of the drum portion 10, the drum portion 10 is filled with dry powder through the aperture 30. After the drum portion 10 is filled, the cover portion 12 is telescoped over the bottom end 16 of the drum portion 10. The concavity 28 in the bottom end 26 of the cover portion 12 mates with and extends substantially through the aperture 30 in the bottom end 16 of the drum portion 10. In the preferred embodiment the concavity 28 has substantially the same configuration as the configuration of the aperture 30. As shown in FIG. 1, the aperture 30 is a circular opening, but it is envisioned and within the scope of the present invention that other shapes could be utilized for the aperture 30.

In order to prevent the dry powder from escaping from the drum portion 10, when the cover portion 12 is inserted over the bottom end 16 of the drum portion 10, and to allow air escape, the inner surface area of the cover 12 is provided with a flocked material 32. For example, cotton can be used as the flocked material 32.

In order to secure the cover portion 12 to the drum portion 10, first and second substantially matching beads 34, 36 are formed respectively in the side walls 14, 24 of the drum portion 10 and cover portion 12. As can be seen in FIGS. 2 and 3, the beads 34, 36 are formed such that they respectively project toward the interior of the drum portion 10 and cover portion 12. When the cover portion 12 is telescoped over the drum portion 10, the first and second beads 34, 36 engage when the cover portion 12 has been fully positioned over the drum portion 10 as depicted in FIG. 3. It is envisioned that other structures ca be utilized to secure the cover 12 to the drum portion 10.

Also, as can be seen in FIGS. 2 and 3, the flocked material 32 covers the inside surface of the side wall 24, the bottom end 26 and the concavity 28. Also, in the preferred embodiment the concavity 28 has an inwardly slopping wall 38. The inwardly slopping wall 38 provides for ease of assembly and a secure engagement with the aperture 30 when the cover portion 12 is fully assembled with the drum portion 10.

The powder drum of the present invention is an improvement over prior art powder drum in that the flocked material 32 lining the inner surface of the cove portion 12 serves to prevent any powder from escaping or puffing out from the side of the drum portion 10 when the cover portion 12 is fitted over the drum portion 10 after the drum portion 10 has been filled with the dry powder. Once the drum portion 10 is filled and the cover portion 12 fitted in place, the entire powder drum is inserted into a powder box (not shown) with the cover portion 12 side down.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An improved powder drum, comprising:

means for containing a dry powder, said means for containing having at least one side wall and top and bottom ends, said top end being substantially open and said bottom end having a predetermined aperture;

means for closing said top end;

means for covering said bottom end and at least a portion of said at least one side wall of said means for containing, said means for covering having at least one side wall that mates with said at least one side wall of said means for containing and having a closed bottom end, said closed bottom end having a concave portion that substantially mates with said aperture in said bottom end of said means for containing; and means for sealing said dry powder in said means for containing at least during assembly of said means for containing and said means for covering, said means for sealing substantially covering an inner surface of said means for covering.

2. The improved powder drum according to claim 1, wherein said means for sealing is a layer of material that presents said dry powder from passing, yet allows air to pass, between said side walls of said means for containing and said means for covering during at least assembly thereof.

3. The improved powder drum according to claim 1, wherein said means for sealing is a layer of flocked material.

4. The improved powder drum according to claim 1, wherein said means for sealing entirely covers inside surfaces of said side wall, said closed bottom end and said concave portion of said bottom end of said means for covering.

5. The improved powder drum according to claim 1, wherein said concave portion of said bottom end of said means for covering substantially extends through said aperture in said bottom end of said means for containing.

6. The improved powder drum according to claim 5, wherein said concave portion has at least one inwardly slopping wall.

7. The improved powder drum according to claim 1, wherein said powder drum further comprises means for securing said means for covering to said means for containing.

8. The improved powder drum according to claim 7, wherein said means for securing comprises first and second substantially matching beads in said side walls of said means for containing and said means for covering, respectively, said first and second substantially matching beads being engaged when said means for containing is assembled with said means for covering.

9. The improved powder drum according to claim 8, wherein each of said first and second substantially matching beads extends completely around said side walls of said means for containing and said means for covering, respectively.

10. The improved powder drum according to claim 8, wherein said means for sealing substantially covers an inner surface of said second bead in said means for covering.

11. The improved powder drum according to claim 1, wherein said means for closing said top end of said means for containing is a frangible material.

12. The improved powder drum according to claim 1, wherein said top end of said means for containing has a flange to which said means for closing is attached.

13. An improved powder drum, comprising:

a drum portion for containing a dry powder and having a side wall with a predetermined configuration, an open top end and a bottom end with an aperture therein having a predetermined configuration;

a closure attached to said open top end of said drum portion that completely closes said top end of said drum portion;

a cover portion having a side wall with substantially the same configuration as the predetermined configuration of said side wall of said drum portion and that telescopes over said side wall of said drum portion, said cover portion also having a closed bottom end with a concavity that mates with and extends substantially through said aperture in said bottom end of said drum portion and that has substantially the same configuration as said predetermined configuration of said aperture; and a flocked material substantially covering an inner surface of said side wall, said closed bottom end and said concavity of said cover portion for sealing said drum portion and said cover portion;

wherein said flocked material substantially prevents said dry powder from escaping from said drum portion at least when said drum portion is assembled with said cover portion.

14. The improved powder drum according to claim 13, wherein said concavity has at least one inwardly slopping wall.

15. The improved powder drum according to claim 13, wherein said power drum further comprises means for securing said cover portion to said drum portion.

16. The improved powder drum according to claim 15, wherein said means for securing comprises first and second substantially matching beads in said side walls of said drum portion and said cover portion, respectively, said first and second substantially matching beads being engaged when said drum portion is assembled with said cover portion.

17. The improved powder drum according to claim 16, wherein each of said first and second substantially matching beads extends completely around said side walls of said drum portion and said cover portion, respectively.

18. The improved powder drum according to claim 16, wherein said means for sealing also substantially covers an inner surface of said second bead in said cover portion.

19. The improved powder drum according to claim 13, wherein said closure on said top end of said drum portion is a frangible material.

20. The improved powder drum according to claim 13, wherein said top end of said drum portion has a flange to which said closure is attached.

* * * * *